US011203052B2

(12) United States Patent
Xu et al.

(10) Patent No.: US 11,203,052 B2
(45) Date of Patent: Dec. 21, 2021

(54) FORGING AND INCLINED WINDOW HOLE PUNCHING COMPOSITE DIE

(71) Applicant: CITIC Dicastal CO., LTD., Hebei (CN)

(72) Inventors: Zuo Xu, Qinhuangdao (CN); Jinling Yang, Qinhuangdao (CN); Li Yang, Qinhuangdao (CN); Xiaoting Zhu, Qinhuangdao (CN); Zhen Wang, Qinhuangdao (CN); Weizhou Liu, Qinhuangdao (CN); Yukun Yang, Qinhuangdao (CN); Haifeng Li, Qinhuangdao (CN); Zhiwei Yang, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 149 days.

(21) Appl. No.: 16/530,991

(22) Filed: Aug. 2, 2019

(65) Prior Publication Data

US 2020/0261963 A1 Aug. 20, 2020

(30) Foreign Application Priority Data

Feb. 15, 2019 (CN) ..... 201910118122.3

(51) Int. Cl.
*B21J 5/02* (2006.01)

(52) U.S. Cl.
CPC ..... *B21J 5/025* (2013.01)

(58) Field of Classification Search
CPC .... B21D 28/002; B21D 28/007; B21D 28/24; B21D 28/30; B21D 37/08; B21D 22/00;
(Continued)

(56) References Cited

U.S. PATENT DOCUMENTS 1,766,217 A * 6/1930 Booth ..... B21D 28/30
72/334
2,132,002 A * 10/1938 Hight ..... B21D 53/265
29/894.362

(Continued)

FOREIGN PATENT DOCUMENTS

CN 104722694 A * 6/2015 ..... B21D 28/325
CN 104722694 A 6/2015

(Continued)

OTHER PUBLICATIONS

Supplementary European Search Report in the European application No. 20154491.3, dated Jul. 14, 2020.

*Primary Examiner* — Adam J Eiseman
*Assistant Examiner* — P Derek Pressley
(74) *Attorney, Agent, or Firm* — Syncoda LLC; Feng Ma

(57) ABSTRACT

A forging and inclined window hole punching composite die includes an upper die holder, a connection sleeve, an upper die sliding sleeve, a pressure plate, inclined window puncher pins, a center puncher pin, first connection screw rods, first springs, second connection screw rods, second springs, hydraulic assistant systems, a lower die and a bottom plate. Bottom surface of the pressure plate of the composite die is a plane to avoid deformation of a front molding surface. Hydraulic power is added to the inclined window puncher pins to increase the pressure for punching inclined holes, avoid quality problems and increase a demolding force. A multi-split synchronous hydraulic device may well realize synchronization of the plurality of inclined window puncher pins.

11 Claims, 3 Drawing Sheets

(58) Field of Classification Search
CPC .. B21D 22/06; B21J 5/02; B21J 5/025; B21K 1/40
See application file for complete search history.

(56) References Cited

U.S. PATENT DOCUMENTS

| | | | | |
|---|---|---|---|---|
| 2010/0018277 | A1* | 1/2010 | Hielscher | C21D 8/0252 72/352 |
| 2015/0375287 | A1* | 12/2015 | Gorski | B21D 22/06 72/325 |

FOREIGN PATENT DOCUMENTS

| | | | | |
|---|---|---|---|---|
| CN | 208408197 | U | 1/2019 | |
| FR | 3053613 | A1 * | 1/2018 | B21D 28/325 |
| SU | 659246 | A1 | 4/1979 | |

* cited by examiner

FORGING AND INCLINED WINDOW HOLE PUNCHING COMPOSITE DIE

CROSS-REFERENCE TO RELATED APPLICATION

The present application claims priority to Chinese Patent Application No. 201910118122.3, filed on Feb. 15, 2019, the contents of which are hereby incorporated by reference in their entirety.

BACKGROUND

Since an existing wheel hub forging die may only punch a center straight hole of a single wheel blank, a metal in an inclined window of the blank needs to be removed by a machining procedure, which brings troubles in the subsequent procedures and also increases the production cycle and the cost. Whether it is possible to realize punching of inclined windows of a wheel hub blank in a very small space of a wheel becomes a project that is very hard to implement. Chinese invention patent No. CN104722694A discloses a wheel forging composite die which completes, in one step, tasks completed in a plurality of procedures such as center hole punching, inclined window punching and rim reaming to reduce the time of subsequently machining a wheel blank and unnecessary procedures, thereby shortening the production cycle of wheels and reducing equipment and manpower occupation time. However, such die may not forge a wheel hub which does not need rim reaming. An upper die pressure surface is not a plane and a positive pressure easily causes a molding surface to deform. The pressure for punching an inclined hole from an inclined window puncher pin of the die is low, which easily causes problems such as unsmooth hole formation and inconsistent puncher pin operation. In addition, a demolding structure of the die only makes use of an elastic force of a spring for demolding, so that the demolding capacity is limited, which is not favorable for simultaneous demolding.

SUMMARY

The present disclosure relates to the technical field of forging dies, and particularly to a forging and inclined window hole punching composite die.

The embodiment of the present disclosure provides a forging and inclined window hole punching composite die which may forge a wheel blank that does not need rim reaming. The bottom surface of a pressure plate is a plane to avoid deformation of a front molding surface. In addition, hydraulic power is added to an inclined window puncher pin to increase the pressure for punching an inclined hole and avoid quality problems. Meanwhile, a demolding force is increased to realize simultaneous demolding of the puncher pins. Therefore, punching of inclined windows of a wheel hub blank and demolding of the inclined window puncher pins are simultaneously performed in a very small space of a wheel, and the structure is ingenious.

In order to achieve the aforementioned objective, the present disclosure provides the following technical solution.

According to an aspect of the disclosure, there is provided a forging and inclined window hole punching composite die, including an upper die holder, a connection sleeve, an upper die sliding sleeve, a pressure plate, inclined window puncher pins, a center puncher pin, first connection screw rods, first springs, second connection screw rods, second springs, hydraulic assistant systems, a lower die and a bottom plate.

The upper die holder includes a circular top surface and a side wall extending downwards around the top surface. The side wall has a certain thickness. The connection sleeve is of a columnar structure, and the connection sleeve is fixedly connected to a bottom of the top surface of the upper die holder. The pressure plate is of a columnar structure. A bottom surface of the pressure plate is a plane. The center puncher pin is disposed in the connection sleeve and located at a center position of the die. The connection sleeve is provided with a plurality of first through holes, which are large in upper part diameter and small in lower part diameter and suitable for the first connection screw rods, around the center puncher pin. Upper ends of the plurality of first connection screw rods are located in the first through holes of the connection sleeve, and lower ends of the plurality of first connection screw rods pass through the first through holes and are fixed to the pressure plate. When the upper die holder is pressed and moves upwards, the upper ends of the first connection screw rods may slide in the connection sleeve. The first springs sleeve the first connection screw rods between the pressure plate and the connection sleeve. The upper die holder is provided with a plurality of second through holes, which are large in upper part diameter and small in lower part diameter and suitable for the second connection screw rods, around the center axial line of the die. Upper ends of the plurality of second connection screw rods are located in the second through holes of the upper die holder, and lower ends of the plurality of second connection screw rods pass through the second through holes and are fixed to the upper die sliding sleeve. The upper die sliding sleeve is of a cylindrical structure. The upper die sliding sleeve sleeves outsides of the connection sleeve and the pressure plate. A plurality of inclined-down and outward inclined slots corresponding to positions, at which need to be punched with inclined window holes, on a workpiece are formed in the side wall of the upper die holder. Correspondingly, the upper die sliding sleeve is provided with slopes parallel to the inclined slots. Sealed cavities and the inclined window puncher pins which correspond to the positions, at which need to be punched with inclined window holes, on the workpiece are disposed in the slopes. The inclined window puncher pins are located in the sealed cavities, with both ends extending out of the sealed cavities. Upper ends of the inclined window puncher pins are located in the inclined slots of the upper die holder. Lower ends of the inclined window puncher pins may punch inclined windows in the workpiece along with the pressing of the upper die holder. Middle part of each of the inclined window puncher pins has a circle of ring-like protrusion. Each ring-like protrusion divides each sealed cavity into an upper cavity and a lower cavity. Each of upper part of the upper cavity and lower part of the lower cavity is provided with an oil pipe joint. The hydraulic assistant system is located on the bottom plate. The hydraulic assistant system is connected with the oil pipe joints of the upper cavities and the lower cavities. When the upper die holder is pressed, the hydraulic assistant system pumps out liquid in the lower cavities and inputs liquid in the upper cavities to push the inclined window puncher pins to be pressed to punch the inclined windows in the workpiece. When the upper die holder moves upwards, the hydraulic assistant system inputs the liquid in the lower cavities and pumps out the liquid in the upper cavities to push the inclined window puncher pins to move upwards and be separated from the workpiece. The lower die is disposed on the bottom plate. The lower die is used for placing the workpiece.

In some embodiments, the hydraulic assistant system may include hydraulic oil pipelines, a main hydraulic cylinder, a main piston rod, branch hydraulic cylinders and branch piston rods. The main piston rod is a piston rod of the main hydraulic cylinder. The branch piston rods are piston rods of the branch hydraulic cylinders. The branch piston rods are fixedly connected to the main piston rod. A tail end of the branch piston rod in the branch hydraulic cylinder has a circle of protruding circular ring. A cylinder body of the branch hydraulic cylinder is divided into a left part and a right part. The left cylinder bodies are connected with the lower cavities through the hydraulic oil pipelines, and the right cylinder bodies are connected with the upper cavities through the hydraulic oil pipelines; or, the right cylinder bodies are connected with the lower cavities through the hydraulic oil pipelines, and the left cylinder bodies are connected with the upper cavities through the hydraulic oil pipelines. By the adoption of this hydraulic assistant system, the die is simple in structure and occupies a small space and solves the problem that punching of the inclined holes and demolding of the inclined window puncher pins may not be simultaneously performed in a very small space in the past.

In some embodiments, one main piston rod may drive a plurality of branch piston rods of a plurality of branch hydraulic cylinders. Preferably, one main piston rod drives three branch piston rods of three branch hydraulic cylinders, or one main piston rod drives six branch piston rods of six branch hydraulic cylinders. A multi-split synchronous hydraulic device may well realize synchronization of the plurality of inclined window puncher pins.

In some embodiments, first grooves are formed in the positions, at which the first connection screw rods are fixed, on the pressure plate, and lower ends of the first springs are placed in the first grooves, and/or second grooves are formed in the positions, at which the second connection screw rods are mounted, on the upper die holder, and the upper ends of the second springs are placed in the second grooves. In this way, the grooves allow the positions of the springs to be fixed and also play a certain protective role for the springs.

In some embodiments, a waste slide carriage is disposed inside the lower die and is used for collecting punching wastes, so that no influence of waste blockage on the performance of the die is likely to occur.

In some embodiments, lower parts of the ring-like protrusions at the middle parts of the inclined window puncher pins in the sealed cavities are provided with third springs, so that the elastic forces of the springs may be used to increase the popup force during demolding, which is more favorable for demolding.

In some embodiments, the lower die is hollow and is divided into an upper part and a lower part. The upper part has a small diameter, and the lower part has a large diameter. A plurality of square empty slots are uniformly formed in the circumference of the lower die. A lower supporting plate is disposed on the bottom plate. The lower supporting plate is located in a lower space of the lower die. Guide columns are fixedly disposed at positions, corresponding to the square empty slots, on the circumference of the lower supporting plate. A tray is fixedly disposed on the guide columns. The tray is composed of separately disposed arc plates or is an integrated circular ring plate. The tray is located on the outer side of the lower die. The lower supporting plate, the guide columns and the tray may slide up and down. Preferably, the lower die is hollow and is divided into an upper part and a lower part. The upper part has a small diameter, and the lower part has a large diameter. Square empty slots are formed in left and right sides of the lower die. A lower supporting plate is disposed on the bottom plate. The lower supporting plate is placed in a lower space of the lower die. Guide columns are fixedly disposed at positions, corresponding to the square empty slots, on the left and right sides of the lower supporting plate. A tray is fixedly disposed on the guide columns. The tray is composed of separately disposed arc plates or is an integrated circular ring plate. The tray is located on the outer side of the lower die. The lower supporting plate, the guide columns and the tray may slide up and down. In this way, the lower supporting plate moves upwards conveniently to drive the tray to move upwards so as to jack up the wheel blank, and a manipulator takes away the wheel blank conveniently.

In some embodiments, a through hole is formed in the middle of the bottom plate. A push rod is disposed below the lower supporting plate. The push rod extends out of the through hole in the middle of the bottom plate. In this way, an ejector jacks up the lower supporting plate conveniently, thereby jacking up the wheel blank.

BRIEF DESCRIPTION OF THE DRAWINGS

The present disclosure will become more fully understood from the detailed description given hereinbelow and the accompanying drawings, which are given by illustration only, and thus are not limitative of the present disclosure, and wherein.

LIST OF REFERENCE SYMBOLS

Figure 1:
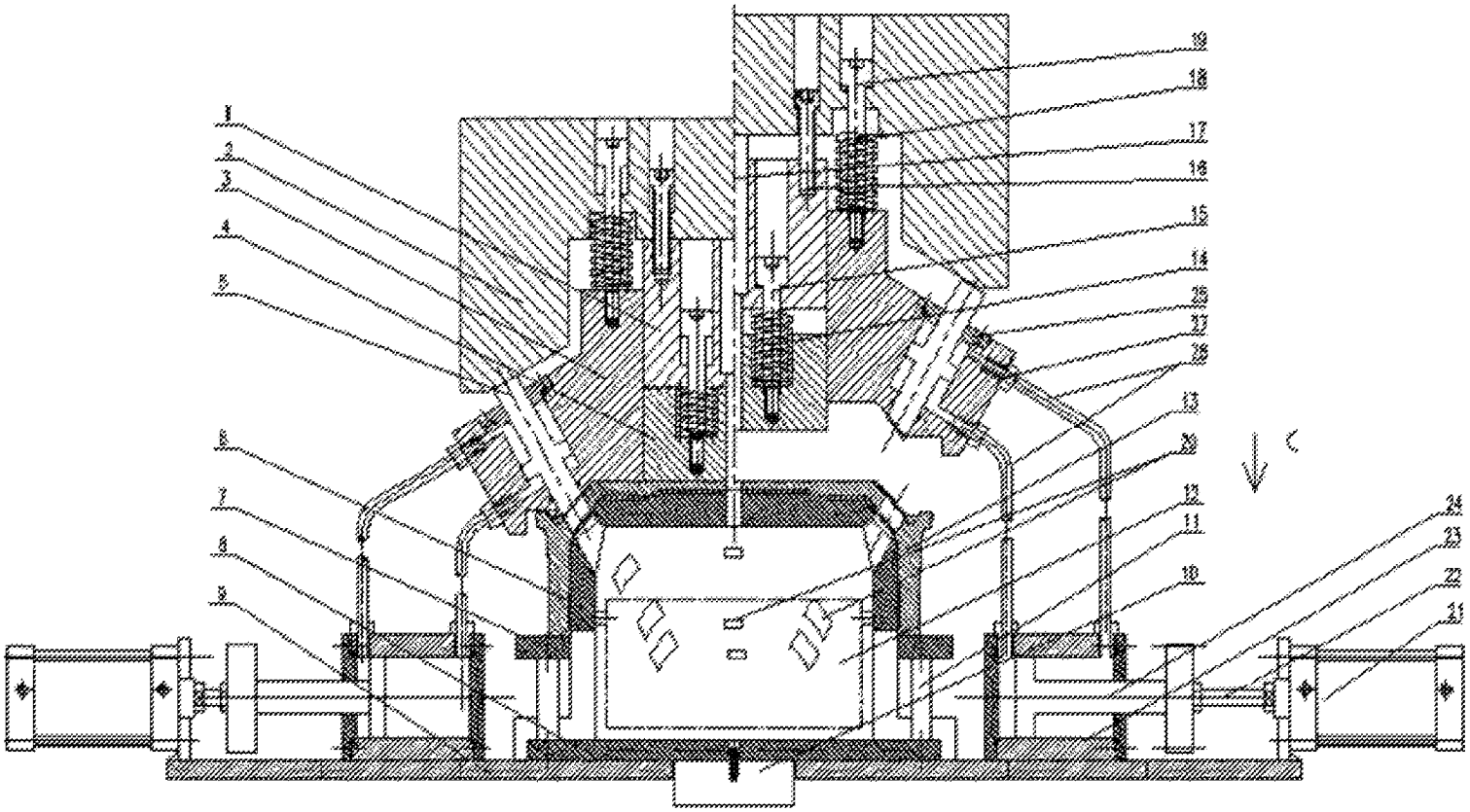
FIG. 1 is a structural schematic diagram of a forging and inclined window hole punching composite die of the present disclosure.

1-connection sleeve; 2-upper die holder; 3-upper die sliding sleeve; 4-pressure plate; 5-inclined window puncher pin; 6-lower die, 7-tray; 8-lower supporting plate; 9-bottom plate; 10-push rod; 11-guide column; 12-waste slide carriage; 13-wheel hub blank; 14-first spring; 15-first connection screw rod; 16-bolt; 17-center puncher pin; 18-second spring; 19-second connection screw rod; 20-punching waste; 21-main hydraulic cylinder; 22-main piston rod; 23-branch hydraulic cylinder; 24-branch piston rod; 25-flange; 26-hydraulic oil pipeline; and 27-oil pipe joint.

DETAILED DESCRIPTION

First Embodiment of the present disclosure is described below in combination with FIGS. 1 and 2.

A forging and inclined window hole punching composite die is provided, including an upper die holder 2, a connection sleeve 1, an upper die sliding sleeve 3, a pressure plate 4, inclined window puncher pins 5, a center puncher pin 17, first connection screw rods 15, first springs 14, second connection screw rods 19, second springs 18, left and right hydraulic assistant systems, a lower die 6, a bottom plate 9, a tray 7, a lower supporting plate 8, a push rod 10, guide columns 11, a waste slide carriage 12 and bolts 16. The upper die holder 2 includes a circular top surface and a side wall extending downwards around the top surface. The side wall has a certain thickness. The connection sleeve 1 is of a columnar structure, and the connection sleeve 1 is fixedly connected to the bottom of the top surface of the upper die holder 2 through the bolts 16. The pressure plate 4 is of a columnar structure. The bottom surface of the pressure plate 4 is a plane. The center puncher pin 17 is disposed in the connection sleeve 1 and located at a center position of the die. The connection sleeve 1 is provided with a plurality of first through holes, which are large in upper part diameter and small in lower part diameter and suitable for the first connection screw rods 15, around the center puncher pin. The upper ends of the plurality of first connection screw rods 15 are located in the first through holes of the connection sleeve, and the lower ends pass through the first through holes and are fixed to the pressure plate 4. When the upper die holder 2 is pressed and moves upwards, the upper ends of the first connection screw rods 15 may slide in the connection sleeve 1. The first springs 14 are disposed on the first connection screw rods 15 between the pressure plate 4 and the connection sleeve 1. The upper die holder 2 is provided with a plurality of second through holes, which are large in upper part diameter and small in lower part diameter and suitable for the second connection screw rods 19, around the center axial line of the die. The upper ends of the plurality of second connection screw rods 19 are located in the second through holes of the upper die holder, and the lower ends pass through the second through holes and are fixed to the upper die sliding sleeve 3. The upper die sliding sleeve 3 is of a cylindrical structure. The upper die sliding sleeve 3 sleeves the outsides of the connection sleeve 1 and the pressure plate 4. First grooves are formed in the positions, at which the first connection screw rods 15 are fixed, on the pressure plate, and the first spring 14 is placed in the first grooves, and second grooves are formed in the positions, at which the second connection screw rods 19 are mounted, on the upper die holder 2, and the upper ends of the second springs 18 are placed in the second grooves. In this way, the grooves allow the positions of the springs to be fixed and also play a certain protective role for the springs. A plurality of inclined-down and outward inclined slots corresponding to positions, which need to be punched with inclined window holes, on a workpiece are formed in the side wall of the upper die holder 2. Correspondingly, the upper die sliding sleeve 3 is provided with slopes parallel to the inclined slots. Sealed cavities and the inclined window puncher pins 5 which correspond to the positions, which need to be punched with inclined window holes, on the workpiece are disposed in the slopes. The inclined window puncher pins 5 are located in the sealed cavities, with both ends extending out of the sealed cavities. A flange 25 is disposed on the upper die sliding sleeve 3. The flange 25 is used for sealing the upper ends of the sealed cavities. The upper ends of the inclined window puncher pins 5 extend out from the flange 25 and are located in the inclined slots of the upper die holder. The lower ends of the inclined window puncher pins 5 may punch inclined windows in the workpiece along with the pressing of the upper die holder. The middle part of each of the inclined window puncher pins 5 has a circle of ring-like protrusion. Each ring-like protrusion divides each sealed cavity into an upper cavity and a lower cavity. Each of the upper part of the upper cavity and the lower part of the lower cavity is provided with an oil pipe joint 27.

Figure 2:
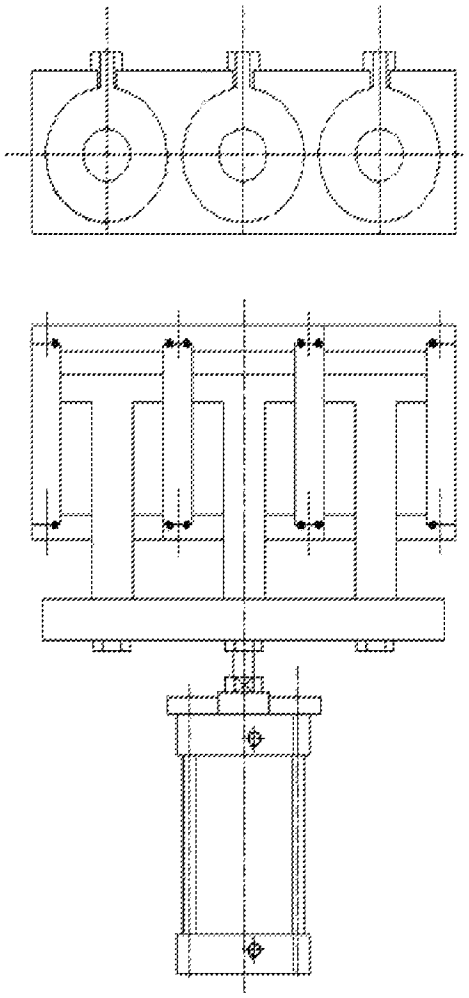
FIG. 2 is a schematic diagram showing that one main hydraulic cylinder drives three branch hydraulic cylinders.

As shown in FIGS. 1 and 2, the left and right hydraulic assistant systems are provided in the present disclosure. Each hydraulic assistant system is connected with three inclined window puncher pins and sealed cavities thereof. The hydraulic assistant system includes hydraulic oil pipelines 26, a main hydraulic cylinder 21, a main piston rod 22, branch hydraulic cylinders 23 and branch piston rods 24. The main piston rod 22 is the piston rod of the main hydraulic cylinder 21. The branch piston rods 24 are the piston rods of the branch hydraulic cylinders 23. The main hydraulic cylinder 21 and the branch hydraulic cylinders 23 are disposed on the bottom plate 9. The branch piston rods 24 are fixedly connected to the main piston rod 22. One main piston rod 22 drives a plurality of branch piston rods of a plurality of branch hydraulic cylinders 23. In the present embodiment, one main piston rod drives three branch piston rods of three branch hydraulic cylinders to move to realize up-down motions of the three inclined window puncher pin 5 dragged by hydraulic power of hydraulic oil. A multi-split synchronous hydraulic device may well realize synchronization of the plurality of inclined window puncher pins. The tail end of the branch piston rod 24 in each of the branch hydraulic cylinders 23 has a circle of protruding ring. A cylinder body of each of the branch hydraulic cylinders 23 is divided into a left part and a right part. The hydraulic oil pipelines 26 are connected with inlet and outlet oil pipe joints 27 of the upper die sliding sleeve 3 and the branch hydraulic cylinders 23. The left cylinder bodies are connected with the lower cavities through the hydraulic oil pipelines 26, and the right cylinder bodies are connected with the upper cavities through the hydraulic oil pipelines 26. Meanwhile, the hydraulic oil pipelines 26 are deformable telescopic rubber pipes. The hydraulic assistant systems are located on the bottom plate 9. The hydraulic assistant systems are connected with the oil pipe joints 27 of the upper cavities and the lower cavities. When the upper die holder 2 is pressed, the hydraulic assistant systems pump out liquid in the lower cavities and input liquid in the upper cavities to push the inclined window puncher pins 5 to be pressed to punch the inclined windows in the workpiece. When the upper die holder moves upwards, the hydraulic assistant systems input the liquid in the lower cavities and pump out the liquid in the upper cavities to push the inclined window puncher pins 5 to move upwards and be separated from the workpiece. The lower die 6 is disposed on the bottom plate 9. The lower die is used for placing the workpiece. By the adoption of the hydraulic assistant systems, the die is simple in structure and occupies a small space and solves the problem that punching of the inclined holes and demolding of the inclined window puncher pins may not be simultaneously performed in a very small space in the past.

The lower die 6 is hollow and is divided into an upper part and a lower part. The upper part has a small diameter, and the lower part has a large diameter. Square empty slots are formed in the left and right sides of the lower die 6. The lower supporting plate 8 is disposed on the bottom plate 9. The lower supporting plate 8 is placed in a lower space of the lower die 6. Guide columns 11 are fixedly disposed at positions, corresponding to the square empty slots, on the left and right sides of the lower supporting plate 8. The tray 7 is fixedly disposed on the guide columns 11. The tray 7 is composed of separately disposed arc plates. The tray 7 is located on the outer side of the lower die 6. The lower supporting plate 8, the guide columns 11 and the tray 7 may slide up and down. In this way, the lower supporting plate moves upwards conveniently to drive the tray 7 to move upwards so as to jack up a wheel blank, and a manipulator takes away the wheel blank conveniently. A waste slide carriage 12 is disposed inside the lower die 6 and is used for collecting punching wastes, so that no influence of waste blockage on the performance of the die is likely to occur. A through hole is formed in the middle of the bottom plate 9. The push rod 10 is disposed below the lower supporting plate 8. The push rod 10 extends out of the through hole in the middle of the bottom plate. In this way, an ejector jacks up the lower supporting plate conveniently, thereby jacking up the wheel blank.

Punching of the inclined window holes requires a high pressure that mainly comes from the pressure of a press slider, and separation of the inclined window puncher pins 5 from a wheel hub blank 13 mainly depends on a friction force. Since the friction force is relatively low, the inclined window puncher pins 5 are separated from the wheel hub blank 13 by mainly depending on the simultaneous action of the elastic forces of the springs and the pressure of the hydraulic oil.

According to the left diagram as shown in FIG. 1, the manipulator places the wheel hub blank 13 on the lower die 6 and then leaves. The press slider drives the upper die holder 2 and the connection sleeve 1 to be pressed. The first connection screw rods 15 slide upwards in the first through holes of the connection sleeve 1. The first springs 14 are compressed till the connection sleeve 1 is in contact with the upper surface of the pressure plate 4. The second connection screw rods 19 slide upwards in the second through holes of the upper die holder 2. The second springs 18 are compressed till the inclined slots in the side wall of the upper die holder downwards press the inclined window puncher pins 5. The upper die sliding sleeve 3, the pressure plate 4 and the inclined window puncher pins 5 fall down, and at the moment, the inclined window puncher pins 5 are located at high positions. In the process that the pressure plate 4 is gradually in contact with the wheel hub blank 13, the inclined window puncher pins 5 move downwards, and the first springs 14 are compressed, and the center puncher pin 17 punches a wheel hub center hole. The inclined window puncher pins 5 punch the inclined window holes under the action of high pressure generated by continuous pressing of the upper die holder 2. Meanwhile, the main piston rod 22 of the main hydraulic cylinder 21 on the left side drives the three branch piston rods 24 of the branch hydraulic cylinders 23 to move leftwards, and the main piston rod 22 of the main hydraulic cylinder 21 on the right side drives the three branch piston rods 24 of the branch hydraulic cylinders 23 to move rightwards. The branch hydraulic cylinders 23 pump out the liquid in the lower cavities of the receiving cavities and input the liquid in the upper cavities of the receiving cavities to push the inclined window puncher pins 5 to be pressed to punch the inclined windows in the workpiece. The pressure action of the hydraulic oil assists in completing the inclined window hole punching process.

According to the right diagram as shown in FIG. 1, the press slider drives the upper die holder 2 and the connection sleeve 1 to move upwards, and at the moment, the pressure plate 4 presses the wheel hub blank 13 under the action of a downward acting force of the first springs 14 to ensure that the center puncher pin 17 is separated. The upper die sliding sleeve 3 presses the wheel hub blank 13 under the downward force of the second springs 18. The main piston rod 22 of the main hydraulic cylinder 21 on the left side drives the three branch piston rods 24 of the branch hydraulic cylinders 23 to move rightwards, and the main piston rod 22 of the main hydraulic cylinder 21 on the right side drives the three branch piston rods 24 of the branch hydraulic cylinders 23 to move leftwards. The branch hydraulic cylinders 23 input the liquid in the lower cavities through the hydraulic oil pipelines and pump out the liquid in the upper cavities to push the inclined window puncher pins 5 to move upwards in the upper die sliding sleeve 3 to separate the wheel hub blank 13. The pressure action of the hydraulic oil assists in completing the separation of the wheel hub blank 13. The press slider continuously moves upwards to complete the process of punching two types of holes. Then, an ejector below a press jacks up the push rod 10 to jack up the wheel hub blank 13 through the lower supporting plate 8, the guide columns 11 and the tray 7, and the manipulator takes the wheel hub blank 13 away.

Second Embodiment

Figure 3:
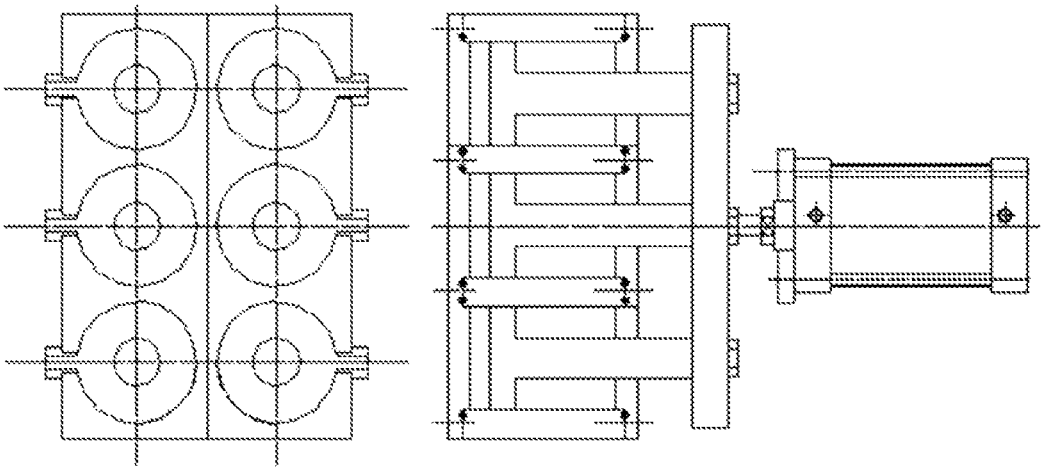
FIG. 3 is a schematic diagram showing that one main hydraulic cylinder drives six branch hydraulic cylinders.

In a forging and inclined window hole punching composite die provided by the present embodiment, a wheel hub blank needs to be punched with six inclined window holes, and one hydraulic assistant system is adopted. With reference to FIG. 3, one main piston rod in the hydraulic assistant system drives six branch piston rods of six branch hydraulic cylinders to move to realize up-down motions of the six inclined window puncher pins 5 dragged by hydraulic power of hydraulic oil. The lower die 6 is hollow and is divided into an upper part and a lower part. The upper part has a small diameter and the lower part has a large diameter. Three square empty slots are uniformly formed in the circumference of the lower die 6. A lower supporting plate 8 is disposed on the bottom plate. The lower supporting plate 8 is located in a lower space of the lower die 6. Guide columns 11 are fixedly disposed at positions, corresponding to the square empty slots, on the circumference of the lower supporting plate 8. A tray 7 is fixedly disposed on the guide columns 11. The tray 7 is composed of separately disposed arc plates. The tray 7 is located on the outer side of the lower die 6. The lower supporting plate 8, the guide columns 11 and the tray 7 may slide up and down. Other technical features are the same as those in the First Embodiment.

In some other embodiments, the tray 7 also may be an integrated circular ring plate to provide a more stable support for the wheel hub blank.

In some other embodiments, the right cylinder bodies of the branch hydraulic cylinders are connected with the lower cavities through the hydraulic oil pipelines, and the left cylinder bodies are connected with the upper cavities through the hydraulic oil pipelines.

In some other embodiments, four, five or six square empty slots are uniformly formed in the circumference of the lower die 6. Guide columns 11 are fixedly disposed at the positions, corresponding to the square empty slots, on the circumference of the lower supporting plate 8.

In some other embodiments, the lower parts of the ring-like protrusions at the middle parts of the inclined window puncher pins 5 in the sealed cavities are provided with third springs, so that the elastic forces of the springs may be used to increase the popup force during demolding, which is more favorable for demolding.

The present disclosure completes, in one step, tasks completed in a plurality of inclined window hole punching procedures and punches a center hole to reduce the time of subsequently machining the wheel blank and unnecessary procedures, thereby shortening the production cycle of the wheels and reducing the equipment and manpower occupation time. The inclined window puncher pins are demolded through synchronous punching of the press and a multi-split synchronous hydraulic device. The processes of punching the inclined windows of the wheel hub blank and demolding the inclined window puncher pins are simultaneously performed in a very small space of the wheel, and the structure is ingenious. The problem that the demolding of the inclined window puncher pins and the punching of the inclined holes may not be simultaneously performed in the very small space in the past is solved. In addition, the action of each part of the whole device is controlled by a Programmable Logic Controller (PLC) to realize coordinative and synchronous work with the press.

It can be seen that in the forging and inclined window hole punching composite die provided by the present disclosure, the bottom surface of the pressure plate is the plane to avoid the deformation of the front molding surface. In addition, the hydraulic power is added to the inclined window puncher pins to increase the pressure for punching the inclined holes and avoid the quality problems. Meanwhile, the demolding force is increased to realize the simultaneous demolding of the puncher pins. Therefore, the punching of the inclined windows of the wheel hub blank and the demolding of the inclined window puncher pins are simultaneously performed in the very small space of the wheel, and the structure is ingenious. In addition, the multi-split synchronous hydraulic device may well realize the synchronization of the plurality of inclined window puncher pins.

To summarize, the application provides a forging and inclined window hole punching composite die, including an upper die holder, a connection sleeve, an upper die sliding sleeve, a pressure plate, inclined window puncher pins, a center puncher pin, first connection screw rods, first springs, second connection screw rods, second springs, hydraulic assistant systems, a lower die and a bottom plate. The bottom surface of the pressure plate of the composite die is a plane to avoid deformation of a front molding surface. Meanwhile, hydraulic power is added to the inclined window puncher pins to increase the pressure for punching inclined holes, avoid quality problems and increase a demolding force. A multi-split synchronous hydraulic device may well realize synchronization of the plurality of inclined window puncher pins. Therefore, simultaneous demolding and punching may be realized, punching of inclined windows of a wheel hub blank and demolding of the inclined window puncher pins are simultaneously performed in a very small space of a wheel, and the structure is ingenious.

Compared with the related art, the technical solutions in the present disclosure have the beneficial effects as follows.

According to the forging and inclined window hole punching composite die provided by the present disclosure, the bottom surface of the pressure plate is the plane to avoid the deformation of the front molding surface; in addition, the hydraulic power is added to the inclined window puncher pins to increase the pressure for punching the inclined holes and avoid the quality problem; furthermore, the demolding force is increased to realize simultaneous demolding of the puncher pins; and therefore, punching of the inclined windows of a wheel hub blank and demolding of the inclined window puncher pins are simultaneously performed in a very small space of a wheel, and the structure is ingenious. In addition, the multi-split synchronous hydraulic device may well realize synchronization of the plurality of inclined window puncher pins. By the arrangement of the third springs, the elastic forces of the springs may be used to increase the popup force during demolding, which is more favorable for demolding.

The invention claimed is:

1. A forging and inclined window hole punching composite die, comprising an upper die holder, a connection sleeve, an upper die sliding sleeve, a pressure plate, inclined window puncher pins, a center puncher pin, first connection screw rods, first springs, second connection screw rods, second springs, hydraulic assistant systems, a lower die and a bottom plate, wherein the upper die holder comprises a circular top surface and a side wall extending downwards around the top surface; the side wall has a certain thickness;

the connection sleeve is of a columnar structure, and the connection sleeve is fixedly connected to a bottom of the top surface of the upper die holder; the pressure plate is of a columnar structure; a bottom surface of the pressure plate is a plane;

the center puncher pin is disposed in the connection sleeve and located at a center position of the die;

the connection sleeve is provided with a plurality of first through holes, around the center puncher pin; upper ends of the plurality of first connection screw rods are located in the first through holes of the connection sleeve, and lower ends of the plurality of first connection screw rods pass through the first through holes and are fixed to the pressure plate; when the upper die holder is pressed and moves upwards, the upper ends of the first connection screw rods slide in the connection sleeve; the first springs sleeve the first connection screw rods between the pressure plate and the connection sleeve;

the upper die holder is provided with a plurality of second through holes, around the center axial line of the die; upper ends of the plurality of second connection screw rods are located in the second through holes of the upper die holder, and lower ends of the plurality of second connection screw rods pass through the second through holes and are fixed to the upper die sliding sleeve; the upper die sliding sleeve is of a cylindrical structure; the upper die sliding sleeve sleeves outsides of the connection sleeve and the pressure plate;

a plurality of inclined-down and outward inclined slots corresponding to positions, at which need to be punched with inclined window holes, on a workpiece are formed in the side wall of the upper die holder; correspondingly, the upper die sliding sleeve is provided with slopes parallel to the inclined slots; sealed cavities and the inclined window puncher pins which correspond to the positions, at which need to be punched with inclined window holes, on the workpiece are disposed in the slopes; the inclined window puncher pins are located in the sealed cavities, with both ends extending out of the sealed cavities; upper ends of the inclined window puncher pins are located in the inclined slots of the upper die holder; lower ends of the inclined window puncher pins punch inclined windows in the workpiece along with the pressing of the upper die holder;

middle part of each of the inclined window puncher pins has a circle of ring-like protrusion; the ring-like protrusion divides the sealed cavity into an upper cavity and a lower cavity; each of upper part of the upper cavity and lower part of the lower cavity is provided with an oil pipe joint;

the hydraulic assistant system is located on the bottom plate; the hydraulic assistant system is connected with the oil pipe joints of the upper cavities and the lower cavities; when the upper die holder is pressed, the hydraulic assistant system pumps out liquid in the lower cavities and inputs liquid in the upper cavities to push the inclined window puncher pins to be pressed to punch the inclined windows in the workpiece; and when the upper die holder moves upwards, the hydraulic assistant system inputs the liquid in the lower cavities and pumps out the liquid in the upper cavities to push the inclined window puncher pins to move upwards and be separated from the workpiece;

the lower die is disposed on the bottom plate; and the lower die is used for placing the workpiece.

2. The forging and inclined window hole punching composite die according to claim 1, wherein the hydraulic assistant system comprises hydraulic oil pipelines, a main hydraulic cylinder, a main piston rod, branch hydraulic cylinders and branch piston rods; the main piston rod is a piston rod of the main hydraulic cylinder; the branch piston rods are piston rods of the branch hydraulic cylinders; the branch piston rods are fixedly connected to the main piston rod; a tail end of the branch piston rod in the branch hydraulic cylinder has a circle of protruding ring; a cylinder body of the branch hydraulic cylinder is divided into a left part and a right part; the left cylinder bodies are connected with the lower cavities through the hydraulic oil pipelines, and the right cylinder bodies are connected with the upper cavities through the hydraulic oil pipelines; or the right cylinder bodies are connected with the lower cavities through the hydraulic oil pipelines, and the left cylinder bodies are connected with the upper cavities through the hydraulic oil pipelines.

3. The forging and inclined window hole punching composite die according to claim 2, wherein one main piston rod drives a plurality of branch piston rods of a plurality of branch hydraulic cylinders.

4. The forging and inclined window hole punching composite die according to claim 2, wherein one main piston rod drives three branch piston rods of three branch hydraulic cylinders, or one main piston rod drives six branch piston rods of six branch hydraulic cylinders.

5. The forging and inclined window hole punching composite die according to claim 1, wherein first grooves are formed in the positions, at which the first connection screw rods are fixed, on the pressure plate, and lower ends of the first springs are placed in the first grooves, and/or second grooves are formed in the positions, at which the second connection screw rods are mounted, on the upper die holder, and the upper ends of the second springs are placed in the second grooves.

6. The forging and inclined window hole punching composite die according to claim 1, wherein a waste slide carriage is disposed inside the lower die.

7. The forging and inclined window hole punching composite die according to claim 1, wherein lower parts of the ring-like protrusions at the middle parts of the inclined window puncher pins in the sealed cavities are provided with third springs.

8. The forging and inclined window hole punching composite die according to claim 1, wherein the lower die is hollow and is divided into an upper part and a lower part; the upper part has a first diameter, and the lower part has a second diameter larger than the first diameter; square empty slots are formed in left and right sides of the lower die; a lower supporting plate is disposed on the bottom plate; the lower supporting plate is placed in a lower space of the lower die; guide columns are fixedly disposed at positions, corresponding to the square empty slots, on the left and right sides of the lower supporting plate; a tray is fixedly disposed on the guide columns; the tray is composed of separately disposed arc plates or is an integrated circular ring plate; the tray is located on the outer side of the lower die; and the lower supporting plate, the guide columns and the tray slide up and down.

9. The forging and inclined window hole punching composite die according to claim 1, wherein the lower die is hollow and is divided into an upper part and a lower part; the upper part has a first diameter, and the lower part has a second diameter larger than the first diameter; a plurality of square empty slots are uniformly formed in the circumference of the lower die; a lower supporting plate is disposed on the bottom plate; the lower supporting plate is located in a lower space of the lower die; guide columns are fixedly disposed at positions, corresponding to the square empty slots, on the circumference of the lower supporting plate; a tray is fixedly disposed on the guide columns; the tray is composed of separately disposed arc plates or is an integrated circular ring plate; the tray is located on outer side of the lower die; and the lower supporting plate, the guide columns and the tray slide up and down.

10. The forging and inclined window hole punching composite die according to claim 8 wherein a through hole is formed in the middle of the bottom plate; a push rod is disposed below the lower supporting plate; and the push rod extends out of the through hole in the middle of the bottom plate.

11. The forging and inclined window hole punching composite die according to claim 9 wherein a through hole is formed in the middle of the bottom plate; a push rod is disposed below the lower supporting plate; and the push rod extends out of the through hole in the middle of the bottom plate.

* * * * *